8/25/87 XR 4,689,074

United States Patent [19]

Seaman et al.

[11] Patent Number: 4,689,074

[45] Date of Patent: Aug. 25, 1987

[54] METHOD AND APPARATUS FOR FORMING ULTRAFINE METAL POWDERS

[75] Inventors: Frederic D. Seaman, Ludington, Mich.; Srinivasan Rajagopal, Cupertino; William H. Altergott, Boulder Creek, both of Calif.

[73] Assignee: IIT Research Institute, Chicago, Ill.

[21] Appl. No.: 752,215

[22] Filed: Jul. 3, 1985

[51] Int. Cl.[4] ..... B22F 1/00

[52] U.S. Cl. ..... 75/0.5 B; 264/10; 264/12; 219/121 LE; 219/121 LF; 420/590; 425/8

[58] Field of Search ..... 264/10, 12; 75/0.5 B; 425/8; 219/121 LE, 121 LF; 420/590

[56] References Cited

U.S. PATENT DOCUMENTS

| | | | |
|---|---|---|---|
| 3,275,787 | 9/1966 | Newberry | 219/69 |
| 4,014,964 | 3/1977 | Probst et al. | 264/10 |
| 4,036,568 | 7/1977 | Morlet et al. | 425/8 |
| 4,218,410 | 8/1980 | Stephen et al. | 264/8 |
| 4,295,808 | 10/1981 | Stephen et al. | 425/8 |
| 4,374,075 | 2/1983 | Yolton et al. | 264/8 |
| 4,383,852 | 5/1983 | Yoshizawa | 75/0.5 B |
| 4,394,332 | 7/1983 | Raman et al. | 264/8 |
| 4,415,512 | 11/1983 | Torobin | 264/9 |
| 4,482,375 | 11/1984 | Sastry et al. | 264/8 |

FOREIGN PATENT DOCUMENTS

| | | |
|---|---|---|
| 1291842 | 4/1969 | Fed. Rep. of Germany . |
| 54-100599 | 8/1979 | Japan . |

OTHER PUBLICATIONS

*Outlook*, vol. 25, No. 2, Sep. 1983, "Caveat Emptor for Kings, Too", University of Illinois at Urbana-Champaign.

"Rapid Solidification Processing of Titanium Alloys", S. M. L. Sastry et al., *Journal of Metals*, Sep. 1983, pp. 21-28.

"Abstract", W. Pietsch et al., *Powder Metall. Int.* (Germany), vol. 15, No. 2, pp. 77-83, May 1983.

*Primary Examiner*—Stephen J. Lechert, Jr.

*Attorney, Agent, or Firm*—Fitch, Even, Tabin & Flannery

[57] ABSTRACT

A method and apparatus for producing ultrafine metal powders in which a laser beam is focused on the surface of a workpiece or feedstock and moved thereacross so as to create a cavity within the workpiece through melting and vaporization that contains the metal melted to form the cavity. A subsonic pulsating blast of inert gas is directed at the cavity to atomize the molten metal, rapidly cool the resulting droplets, and transport the droplets to a collection area. The cavity formed by the laser beam is a "keyhole" of deep cavity having a depth approximately three to four times greater than its width. The focal point of the laser beam is moved across the workpiece at a rate from approximately 50 to 80 inches per minute to ensure that the molten metal remains in the cavity prior to the gas atomization.

Alloy metal powders can be produced by this method of laser blast atomization providing an alloying metal at the base metal where the cavity is formed so that, upon melting of the base metal, the alloy metal will melt into solution with the molten base metal in the cavity prior to gas atomization. Additionally, nonmetallic impurities may be removed from the molten metal contained within the cavity formed by the laser beam by vaporization.

21 Claims, 3 Drawing Figures

METHOD AND APPARATUS FOR FORMING ULTRAFINE METAL POWDERS

The present invention relates to powder metallurgy, and more particularly to a method and apparatus for producing ultrafine, substantially homogeneous metal particles for subsequent use in powder metallurgy processes.

BACKGROUND OF THE INVENTION

Powder metallurgy techniques, by which products are made by compacting metal powders into a mold and sintering, have become increasingly important in the production of products for, e.g., aerospace applications. Power metallurgy proves particularly useful for making parts of refractory metals that have such high melting points that conventional melting and casting is difficult. Powder metallurgy results in a finer and more uniform grain size, with a minimum of segregation and grain boundary precipitates.

Many methods have been used for producing the metal powders used in powder metallurgy including, among others, crushing, atomizing, condensation, reduction, precipitation, electrodeposition and the characteristics of the powders depend, to a great extent, on the specific manufacturing process utilized. Perhaps the most important characteristic is the size of the individual particles made by the process. As the particles become smaller, the cumulative surface area of the particles increases very rapidly. This has an extremely important bearing on the properties of the powder, its behavior during processing into solid bodies, and the ultimate properties of these products Finer homogeneous (i.e. having an amorphous and/or microcrystalline structure) grains promote better strength, toughness and corrosion resistance. Further, ultrafine grain size (particles having a mean diameter of less than 125 microns) often make it possible to achieve superplastic behavior, which is of enormous benefit in near-net forming the material.

Another factor affecting the processing behavior of the metal powder and the final properties of the products made therewith is the shape of the individual particles. This, too, proves highly dependent upon the method of the producing the powder. Spherical powders are most desirable as they permit the maximum number of particles to fill a given volume.

One advantageous method of creating the metal powders for use in powder metallurgy is to melt a metal workpiece, create droplets of the molten metal, and rapidly solidify the molten droplets. Several processes are reviewed in Rapid Solidification Processing of Titanium Alloys, *Journal of Metals,* September 1983, namely: laser surface melting, electron-beam melting and splat quenching, laser melting/spin atomization, and ultrasonic gas atomization. Laser surface melting involves the self-quenching of a thin melted surface layer on a bulk material substrate by irradiating the surface of the material with a laser beam that transverses the surface at rates of between 1 and 50 cm per second to create melt depths of 10–1,000 microns. The molten droplets may be expelled by centrifugal force or by use of an ultrasonic gas jet having a high velocity (Mach 2–2.5), and a high frequency (80–100 kHz) to create inert gas pulses to rapidly atomize and solidify a stream of molten metal. Such techniques have resulted in homogeneously distributed, fine, incoherent dispersoids. However, because these processes involve rotating the feedstock at high angular velocities (up to 30,000 rpm), they are limited to materials that can be conventionally melted and formed into complex feedstock shapes. This, consequently, limits the different types of materials that can be made into powders, as well as limiting the amount of powder that can be produced from a given workpiece. Further, the melting of the material prior to the casting of the feedstock also adds contaminants. New powder applications require the manufacture of powders from alloying materials having widely different physical characteristics. New processes for making powders must also eliminate contamination while retaining powder homogeneity. Further, it is desirable to obtain higher yields of ultrafine (in the 25–50 micron range), spherical particles at higher rates of production, while obtaining a greater consistency and predictability in the production thereof.

SUMMARY OF THE INVENTION

Accordingly, it is the principal object of the present invention to provide an improved method and apparatus for producing ultrafine metal particles, such method and apparatus producing a higher yield of ultrafine particles than presently known methods and apparatus.

It is an additional object to provide such a method and apparatus that is sufficiently flexible to permit alloying the powders with materials having vastly different physical characteristics, while minimizing contamination of the powders.

A further object is to provide such a method and apparatus in which there is a consistency and predictability of results.

These objects and others, which will become apparent upon reference to the accompanying drawings and the detailed description that follows, are provided by a method and apparatus in which a laser beam is focused on the surface of a workpiece or feedstock and moved thereacross so as to create a cavity within the workpiece that contains the metal melted to form the cavity. A subsonic pulsating blast of inert gas is directed toward the cavity to atomize the molten metal, rapidly cool the resulting droplets, and transport the droplets to a collection area. The cavity formed by the laser beam is a "keyhole" or deep cavity having a depth approximately three to four times greater than its width. The focal point of the laser beam is moved slowlyl across the workpiece at a rate from approximately 50 to 80 inches per minute to ensure that the molten metal remains in the cavity prior to the gas atomization. In a preferred method, the workpiece is preheated to a temperature of approximately 400° F. with the laser beam before the cavity is formed.

Alloy metal powders can be produced by this method of laser blast atomization by providing an alloying metal at the base metal where the cavity is formed so that, upon melting of the base metal, the alloy metal will melt into solution with the molten base metal in the cavity prior to gas atomization. Where the alloying metal has a higher vapor pressure in its molten state than the base metal, the feedstock is fabricated with a layer of the alloying material sandwiched therein so as to be located at the base of cavity to be formed by the laser. Thus, the weight of the molten base metal that first forms in the cavity prevents the alloying material from vaporizing prior to forming a solution with the molten base metal. If the alloying metal has a melting temperature higher than that of the base metal, the alloying metal may be placed at the surface of the base metal prior to the formation of the cavity. Accordingly, the cavity formed within the workpiece will contain both the molten base metal and alloy additions. Additionally, nonmetallic impurities may be removed from the molten metal contained within the cavity formed by the laser beam by vaporization.

DETAILED DESCRIPTION

Laser blast atomization of metal and the rapid solidification of the droplets formed thereby can produce minute, ultrafine, and very homogeneous particles with little or no segregation, high levels of chemical uniformity and greatly refined second-phase morphology and distribution. These particles are the product of using a laser beam to produce a cavity in the workpiece. This keyhole cavity formation occurs only at relatively high laser beam power density levels in the range of $10^5$–$10^6$ W/cm$^2$. At a given power density, penetration of the laser beam increases in proportion to the exposure time to the 0.6 power. Because the melt zone is quite narrow due to the sharply focused beam, the melt depth should greatly exceed the grain size of the starting material.

Figure 2:
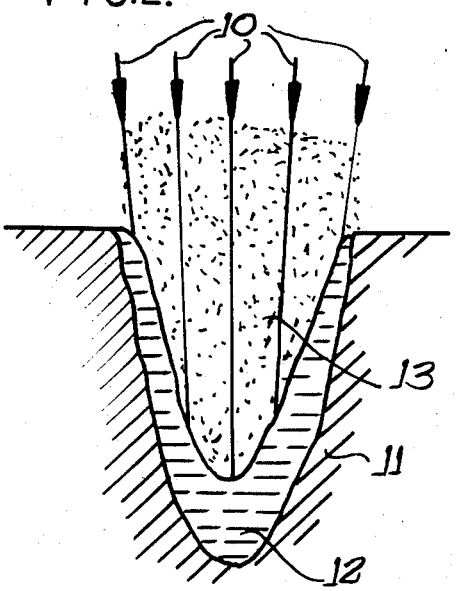
FIG. 2 is a schematic, cross-sectional view of the workpiece surface illustrating the melt and vaporization zones of the keyhole formed by the laser.
Figure 3:
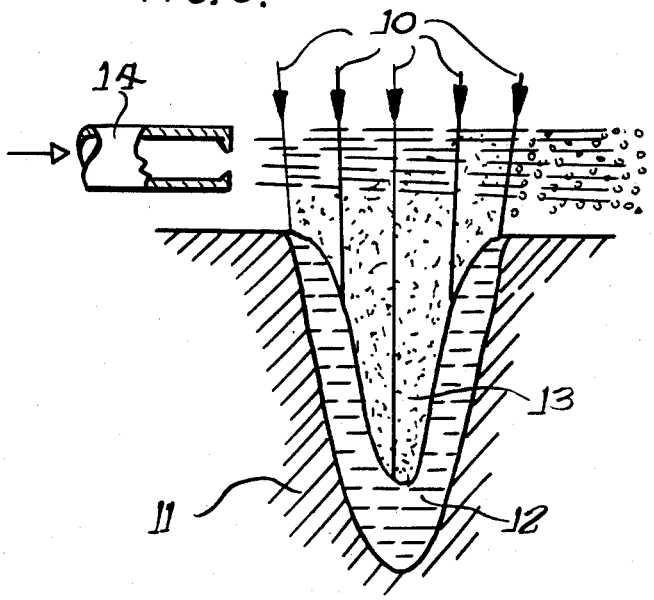
FIG. 3 is a schematic, cross-sectional view of the workpiece surface illustrating the gas jet solidification of the particles at the keyhole.

Describing the surface phenomena of the interaction of the laser beam with the workpiece, as shown in FIGS. 2 and 3, a laser beam 10 focused on the workpiece 11 forms a melt zone 12 on the surface thereof. The melt zone 12 progresses below the surface of the workpiece 11 and a vapor zone 13 starts forming on the surface. Upon continued interaction with the laser beam, the melt and vapor zones progess well below the surface of the workpiece to form a cavity, substantially as illustrated in FIG. 2. In practice, the cavity has a depth approximately three to four times greater than its width and is between approximately one-quarter to one-half inch deep. As the vapor pressure of the metal exceeds the liquid column presure, particles of the liquid metal are blown up through the cavity. At this time a gas jet 14 (FIG. 3) is introduced to rapidly solidify the particles and blow them onto a collector. The gas jet utilizes an inert gas, preferably helium, having a pressure of approximately 700 psig and pulsed at approximately 172 Hz. As the workpiece 11 is moved the cavity is propagated continuously and particles are ejected therefrom. Preferably, the workpiece 11 is in the form of a disc that is rotated so that the focal point of the baser beam 10 moves across the workpiece 11 at a rate of between approximately 50 and 80 inches per minute. (In practice, the focal point of the laser beam is below the surface of the workpiece.)

Alloy metal powders can be advantageously produced by "layering" the alloying metal with the base metal. The method takes into account the differing melting temperatures and the vapor pressures of the alloying material and base metal to ensure that the alloying material is melted into solution with the molten base metal before the vaporization or atomization thereof. Specifically, if the alloying metal has a higher vapor pressure in its molten state than the base metal, the workpiece is formed with a layer of the alloying metal disposed or sandwiched under the surface thereof at a depth equal to approximately the depth of the keyhole formed by the laser. Thus, a head of molten and vaporized base material will exert a fluid pressure on the alloying metal prior to its being vaporized by the laser. This prevents the alloying metal from vaporizing out of the base metal before it can form a solution with the molten base metal. If the alloying metal has a higher melting temperature than the base metal, alloy metal powders can be formed by distributing the alloy addition over the surface of the workpiece so that the alloying metal will melt prior to the melting of the base metal.

Several advantages accrue to methods described above. The use of a laser beam for melting the base metal obviates the need for crucibles and the associated melt-handling equipment, as the still-solid bulk of the underlying base metal serves as a crucible for the melt puddle formed by the laser. This leads to a cleaner melt devoid of crucible-induced contamination. Laser melting also produces very high superheat levels in the molten metal (up to the vaporization temperature). The resulting low surface tension promotes formation of very small liquid droplets whose high relative surface area enhances rapid cooling.

The method also provides for the removal of nonmetallic inclusions in the metal stock. Because nonmetallic inclusions are strong absorbers of 10.6 micron laser radiation, the inclusions are preferentially vaporized during the melt sequence, yielding cleaner microstructures in the particles and minimizing potential heterogenous nucleation sites, thereby promoting greater degrees of supercooling before solidification commences.

Figure 1:
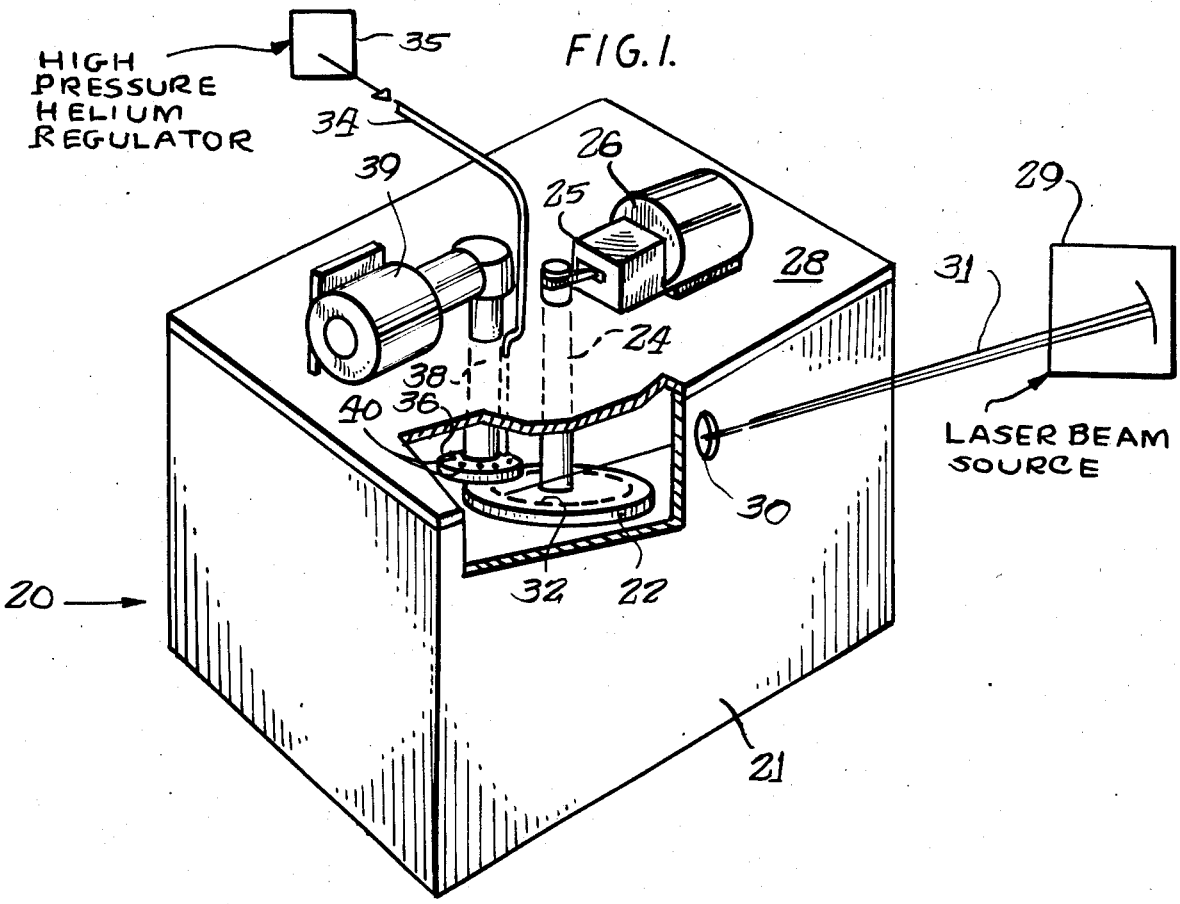
FIG. 1 is a perspective-schematic view of an apparatus in accordance with the present invention.

An apparatus for performing the above-described method is illustrated in FIG. 1. The apparatus, generally indicated by 20, includes a containment vessel 21 in which an inert gas atmosphere is maintained. A workpiece 22 in the form of a disk is attached to the end of a drive spindle 24 rotated by a belt 25 and motor 26 supported on a mounting plate 28 that also forms the upper portion of the containment vessel 21. A $CO_2$ laser beam, generally indicated by 29, is focused through a beam access port 30 in the containment vessel 21 so that the beam 31 generated thereby has its focal point below the surface of the workpiece 22. As the workpiece 22 is rotated by the drive spindle 24, a melt zone, generally indicated by the dotted line 32, is formed. The rate of rotation of the drive spindle 24 is such that the melt zone moves at a rate between 50 and 80 inches per minute with respect to the focal point of the laser beam. This speed ensures that the molten material formed in the melt zone keyhole previously described remains substantially within the cavity until atomized by a pulsing gas jet. Coincident with the melt zone 32 is a high-pressure gas jet, indicated by 34, that is connected to a high-pressure regulator 35. Preferably, helium is used for the gas jet due to its high ionization potential, which minimizes plasma formation at the point of laser beam/-metal interaction. Further, the inert nature of helium shields the melt and the particles from atmospheric contamination. The gas jet provides high velocities and high convective heat transfer coefficients to ensure rapid solidification.

To pulse the blast created by the jet 34, a flow interrupter disk 36 is mounted on a drive spindle 38 rotated by a motor 39 mounted on the top 28 of the containment vessel 21. The disk 36 is disposed adjacent the nozzle end of the jet and has a series of holes 40 at the periphery thereof and positioned so that, as the disk 36 rotates, the holes 40 will move into and out of alignment with the nozzle of the jet 34 to alternately permit and prevent the gas from impinging upon the melt zone 32. By selectively rotating the flow interrupter disk 36 at various speeds, a variety of pulse rates can be obtained. Preferably, the interrupter disk 36 is rotated to obtain a subsonic pulse rate of approximately 172 Hz. At the bottom of the containment vessel 36 is a receptacle (not shown) for receiving the metal powder generated by the apparatus. The molten droplets generated by the laser melt/gas blast solidify as they fly to the bottom of the containment vessel 21 through the helium atmosphere.

Four trial runs were made with the above-described apparatus in which the workpiece was a wrought Inconel 600 disk having a thickness of ⅜ inch. A laser beam having a power of 12 KW was aimed to have its focal point coincident with the disk surface and the exposure time of the laser beam on the workpiece was 30 seconds.

In the first run, an effective beam scan rate of 84 inches per minute was employed with the helium gas jet of 700 psig being pulsed at a rate of 172 Hz. This resulted in the production of 41.2% (by weight) of particles having a diameter of less than 125 microns, with 79.2% of these particles being roughly spherical with a mean spherical diameter of 55 microns.

In the second run, the effective beam scan rate was 60 inches per minute, while, once again, a helium gas jet at 700 psig was pulsed at a rate of 172 Hz. This produced particles of which 39.2% (by weight) had a mean diameter of less than 125 microns, with 77.9% of these particles being roughly spherical with a mean spherical diameter of 50 microns.

In a third run, the effective beam scan rate was 60 inches per minute with the beam scanned over the disk for three revolutions prior to initiating the gas blast. Once again, the helium gas jet of 700 psig at a pulse rate of 172 Hz was employed. This produced particles where 42.1% (by weight) were less than 125 microns in diameter, with 68.6% of these particles being roughly spherical, with a mean spherical diameter of less than 25 microns.

In a fourth run, the effective beam scan rate was 60 inches per minute and a continuous gas blast of helium at 700 psig was employed. The beam scanned over the disk three revolutions prior to initiating the gas blast. This produced particles in which 15.2% were less than 125 microns in diameter, with 72.4% of these particles being roughly spherical with a mean spherical diameter of less than 25 microns.

As indicated by runs 3 and 4, it is believed that the beam preheating resulted in higher yield of small spherical particles and that the pulsating gas blast and preheating of the workpiece enhanced the formation of spherical particles. Examination of the particles of run 3 revealed a spherical grain morphology, indicating supercooling in excess of 170° C. and a cooling rate on the order of $10^{6°}$ K./s. While runs 3 and 4 were conducted with the laser preheating the workpiece, bulk preheating of the stock prior to laser processing may also be employed. The preheating increases the absorptivity of the workpiece and promotes higher levels of superheat, thus minimizing surface tension to generate smaller particles.

Accordingly, it can be seen that an improved method and appratus for producing ultrafine metal powders has been provided. While the invention has been described in terms of the preferred method and apparatus, there is no intent to limit it to the same. On the contrary, it is intended to include all modifications within the scope of the appended claims.

What is claimed is:

1. A method for producing metal powders from a pre-formed metal workpiece comprising:

(a) focusing a laser beam through the plane at the surface to a focus below the surface of the workpiece;

(b) moving the focal point of the laser beam relative to the workpiece;

(c) creating a cavity below the surface of the workpiece through melting and vaporization with the laser beam, the cavity containing the metal melted to form the cavity; and (d) directing a pulsating blast of inert gas at the cavity to atomize the molten metal, rapidly cool the resulting droplets, and transport the droplets to a collection area.

2. The method of claim 1 including the step of preheating the workpiece to a temperature of approximately 400° F.

3. The method of claim 2 wherein the workpiece is preheated with a laser beam.

4. The method of claim 1 wherein the laser has a power density between approximately $10^5$ and $10^6$ W/cm$^2$.

5. The method of claim 1 wherein the focal point of the laser beam is moved across the workpiece at a rate from approximately 50 to 80 inches per minute.

6. The method of claim 1 wherein the cavity created in the workpiece by the laser beam has a depth approximately 3 to 4 times greater than its width.

7. The method of claim 5 wherein the cavity created in the workpiece by the laser beam has a depth approximately 3 to 4 times greater than its width.

8. The method of claim 6 wherein the cavity is between approximately one-quarter to one-half inch deep.

9. The method of claim 7 wherein the cavity is between approximately one-quarter to one-half inch deep.

10. The method of claim 1 wherein the inert gas has a pressure of approximately 700 psig and is pulsed at approximately 172 Hz.

11. The method of claim 10 wherein the inert gas is helium.

12. A method for producing metal powders from a pre-formed metal workpiece comprising:

(a) focusing a laser beam below the surface of the workpiece;

(b) moving the focal point of the laser beam relative to the workpiece;

(c) creating a cavity within the workpiece through melting and vaporization with the laser beam, the cavity having a depth approximately 3 to 4 times greater than its width, the depth being between approximately one-quarter to one-half inch deep, the cavity containing the metal melted to form the cavity;

(d) directing a pulsating blast of inert gas at the cavity to atomize the molten metal, rapidly cool the resulting droplets, and transport the droplets to a collection area.

13. A method for producing alloy metal powders by means of laser blast atomization, the steps comprising:

(a) forming a workpiece of the base metal;

(b) providing an alloying metal to the base metal;

(c) focusing a laser beam below the surface of the workpiece;
(d) moving the focal point of the laser beam relative to the workpiece;
(e) creating a cavity within the workpiece through melting and vaporization with the laser beam;
(f) melting the alloying material within the cavity and combining the melted alloy material with the base metal to form a molten metal solution;
(g) directing a pulsating blast of inert gas at the cavity to atomize the molten metal solution, rapidly cool the resulting droplets, and transport the droplets to a collection area.

14. A method for producing alloy metal powders by means of laser blast atomization wherein the alloying metal has a higher vapor pressure in its molten state than the base metal, the steps comprising:
(a) forming a workpiece of the base metal with a layer of alloying material a pre-determined distance below the surface thereof;
(b) focusing a laser beam below the surface of the workpiece;
(c) moving the focal point of the laser beam relative to the workpiece;
(d) creating a cavity within the workpiece with the laser beam to the depth of the layer of alloying material, the cavity containing the metal and alloy addition melted during the formation of the cavity;
(e) melting the layer of alloying material at the base of the cavity, where high vapor pressures, caused by the weight of the molten metal that forms the cavity walls, to prevent the alloying material from vaporizing prior to forming a solution with the molten base metal; and
(f) directing a pulsating blast of inert gas at the cavity to atomize the molten metal solution, rapidly cool the resulting droplets, and transport the droplets to a collection area.

15. A method of producing alloy metal powders by means of laser blast atomization wherein the alloying metal has a melting temperature higher than the base metal, the steps comprising:
(a) distributing the alloying metal over the surface of a workpiece made of the base metal;
(b) focusing a laser beam below the surface of the workpiece;
(c) moving the focal point of the laser beam relative to the workpiece;
(d) creating a cavity within the workpiece through melting and vaporization with the laser beam, the cavity containing the metal and alloy addition melted to form a molten solution during the formation of the cavity; and
(e) directing a pulsating blast of inert gas at the cavity to atomize the molten solution, rapidly cool the resulting droplets, and transport the droplets to a collection area.

16. A method of removing nonmetallic impurities from a workpiece when producing metal powders comprising:
(a) focusing a laser beam below the surface of the workpiece;
(b) slowly moving the focal point of the laser beam across the workpiece;
(c) creating a cavity within the workpiece through melting and vaporization with the laser beam, the cavity containing the metal melted to form the cavity;
(d) suspending the impurities in the molten metal within the cavity;
(e) vaporizing the impurities with the laser beam; and
(f) directing a pulsating blast of inert gas at the cavity to atomize the molten metal, rapidly cool the resulting droplets, and transport the droplets to a collection area.

17. An apparatus for producing ultrafine metal powders comprising, in combination,
(a) containment means having an inert gas atmosphere therein;
(b) means for supporting and moving a workpiece associated with the containment means;
(c) laser beam means associated with the containment vessel so that the focal point of the laser beam is coincident with and penetrating into the workpiece; and
(d) pulsating gas jet means associated with the containment vessel and directed toward the workpiece.

18. The combination of claim 17 wherein the pulsating gas jet means comprises nozzle means, flow interrupter means having a plurality of apertures therein movable into alignment with the nozzle means to permit the flow of gas toward the workpiece and out of alignment with the nozzle to obstruct such flow, and means for moving the flow interrupter means.

19. The combination of claim 18 wherein the pulsating gas jet means pulses helium at aproximately 172 hz and at a pressure of approximately 700 psig.

20. The combination of claim 17 wherein the laser beam means has power density between appoximately $10^5$ and $10^6$ W/cm$^2$.

21. The combination of claim 17 wherein the workpiece supporting and moving means moves the workpiece at a rate between approximately 50 and 80 inches per minute with respect to the focal point of the laser beam means.

* * * * *